US005343942A

United States Patent [19]

Del Serra et al.

[11] Patent Number: 5,343,942

[45] Date of Patent: Sep. 6, 1994

[54] SUBMERSIBLE PUMP LINE PROTECTOR

[75] Inventors: David Del Serra; Lawrence E. Doty, both of Claremore, Okla.

[73] Assignee: Baker Hughes Incorporated, Houston, Tex.

[21] Appl. No.: 3,919

[22] Filed: Jan. 13, 1993

[51] Int. Cl.[5] ..... E21B 4/04

[52] U.S. Cl. ..... 166/66.4; 166/77; 166/241.7

[58] Field of Search ..... 166/53, 65.1, 66.4, 166/68, 77, 96, 105, 241.7, 356

[56] References Cited

U.S. PATENT DOCUMENTS 4,422,504 12/1983 Moore ..... 166/241
4,543,998 10/1985 Thomerson ..... 166/241.7 X
4,601,334 7/1986 Lovegrove ..... 166/241.7
4,603,737 8/1986 Spikes ..... 166/241.7

*Primary Examiner*—Roger J. Schoeppel

*Attorney, Agent, or Firm*—Felsman, Bradley, Gunter & Dillon

[57] ABSTRACT

A line protector protects a line which is strapped to a string of well tubing made up of sections that secure together by threaded couplings. The line protector includes a channel member having upper and lower ends, a base and two spaced apart sidewalls extending therefrom, defining a receptacle for receiving the line. An aperture is located in a central portion of the base between the upper and lower ends and configured for receiving an outer edge portion of the coupling. The channel member is strapped to the tubing with the base in contact with the tubing, with the outer edge portion of the coupling located in the aperture, and with the line located in the receptacle and having a portion in contact with the outer edge portion of the coupling. An adapter is strapped to the tubing between couplings for protection in a midsection area of the section of tubing.

23 Claims, 5 Drawing Sheets

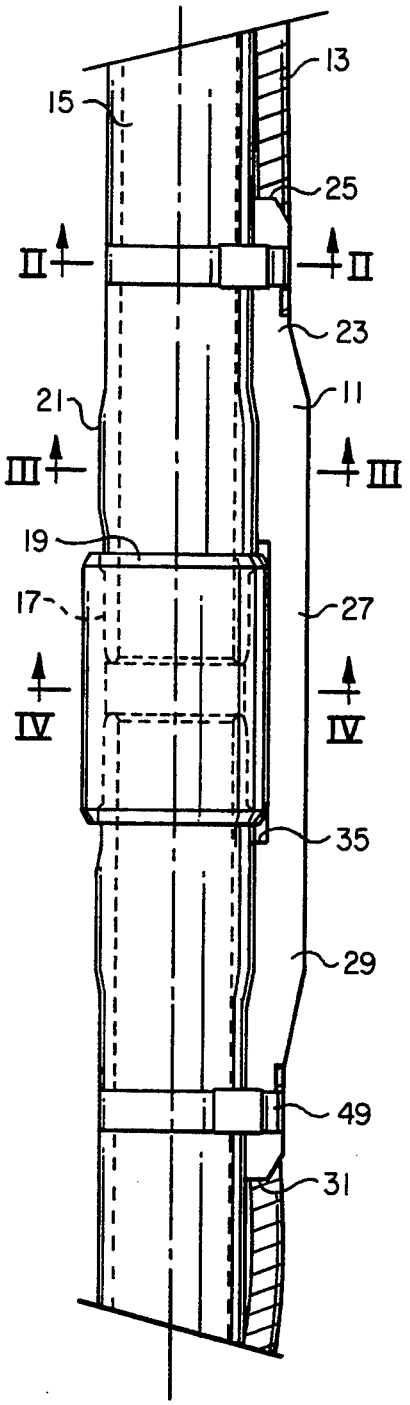
FIG. 1
FIG. 2
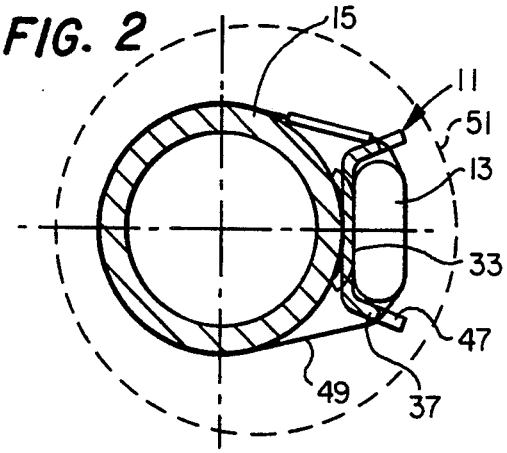
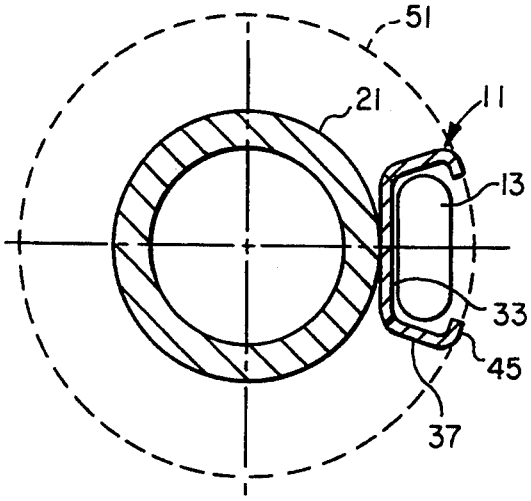
FIG. 3
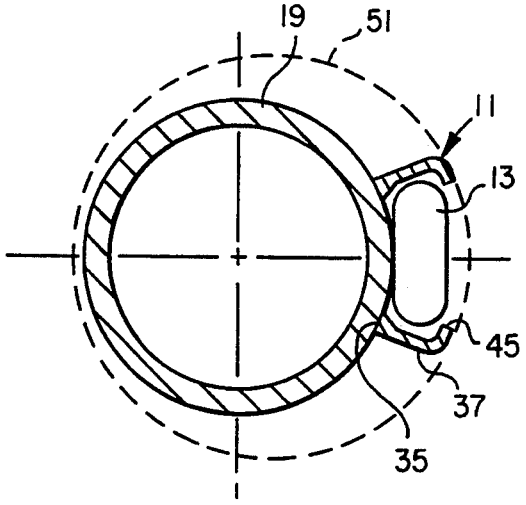
FIG. 4

SUBMERSIBLE PUMP LINE PROTECTOR

BACKGROUND OF THE INVENTION

1. Field of the Invention

This invention relates in general to submersible well pump installations, and in particular to a protector for protecting lines such as power cable that extends alongside production tubing to a submersible pump assembly in the well.

2. Description of the Prior Art

In a submersible pump installation, the pump and electrical motor will normally be suspended on a string of tubing within casing. Three phase power cable will extend down the well alongside the tubing. The cable will be strapped to the tubing at various points to prevent damage to the cable as the tubing and submersible pump assembly are lowered into the well. In some cases other lines, such as electrical lines or hydraulic lines, may also be strapped to tubing and extend to a submersible pump assembly.

In some cases, because of sharp corners at the casing joints or tight confines, it will be important to protect the lines or cable. Otherwise, the cable or lines might be cut or crushed because of contact with a sharp edge. This is particularly a problem at the point where the cable or line extends around the couplings that connect the joints of tubing together. These couplings are of a larger diameter than the tubing sections. Also, it is particularly a problem in small diameter casing wells, and in wells where different weights of casing have been installed in a single well. If different weight, even though the outer diameter is the same, the inner diameter will differ, creating ledges at the junctions between the different weights of casing.

Protectors to protect cable and lines as they pass over the coupling are known. One type comprises a channel member that traps the cable between a base of the channel member and the coupling. This type has hinged clamps which clamp about the tubing above and below the coupling. While successful, this type is fairly expensive to manufacture. Also, different sizes are required for power cables that differ significantly in size.

SUMMARY OF THE INVENTION

The cable or line protector of this invention includes a channel member. It has a base with spaced apart sidewalls that extend outward from the base, defining a receptacle for receiving a cable or a line. However, the base abuts against the tubing, and does not trap the cable between the base and the tubing.

An aperture is located in a central portion of the base. This aperture is configured for receiving an outer edge portion of the tubing couplings. A securing means, preferably straps, will secure the upper and lower ends of the channel member to the tubing with the base in contact with the tubing.

An adapter may be used if it is desired to place a line protector between couplings. The adapter is an elongated member having an outer edge portion that protrudes from one side of the tubing. The adapter is strapped to the tubing. The line protector straps to the tubing over the adapter. The aperture in the line protector receives the adapter.

BRIEF DESCRIPTION OF THE DRAWINGS

FIG. 1 shows a side view of a line protector mounted to a string of tubing.

FIG. 2 is a sectional view of the line protector of FIG. 1, taken along the line II—II of FIG. 1.

FIG. 3 is a sectional view of the line protector of FIG. 1, taken along the line III—III of FIG. 1.

FIG. 4 is a sectional view of the line protector of FIG. 1, taken along the line IV—IV of FIG. 1.

DETAILED DESCRIPTION OF THE INVENTION

Figure 5:
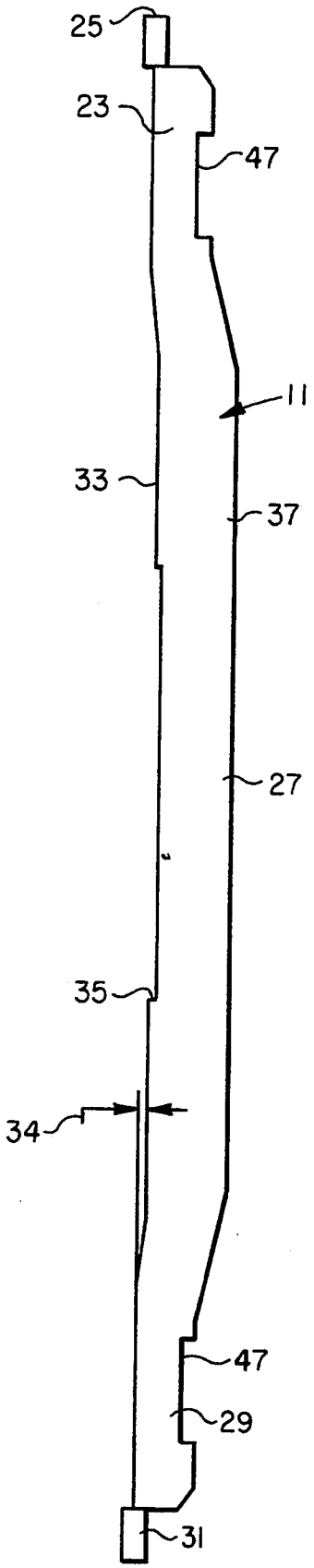
FIG. 5 is a side view of the line protector of FIG. 1, shown prior to mounting to a string of tubing.

Referring to FIG. 1, the line protector includes a channel member 11. Channel member 11 protects a power cable 13 which extends to an electrical submersible pump motor (not shown). Power cable 13, as shown schematically in FIGS. 2–4, is flat cable, having three insulated conductors (not shown) located alongside each other. Cable 13 extends alongside a string of tubing 15, which will support the pump and motor. Normally, the fluid will be produced through tubing 15.

Tubing 15 is made up of sections of tubing, each having threaded ends 17. The threaded ends 17 are secured together by couplings 19. Each coupling 19 has a greater outer diameter than the outer diameter of the sections of tubing 15. In some types of tubing 15, an upset area 21 locates next to each threaded end 17. The upset area 21 is of slightly greater outer diameter than the remaining portions of each section of tubing 15.

Figure 7:
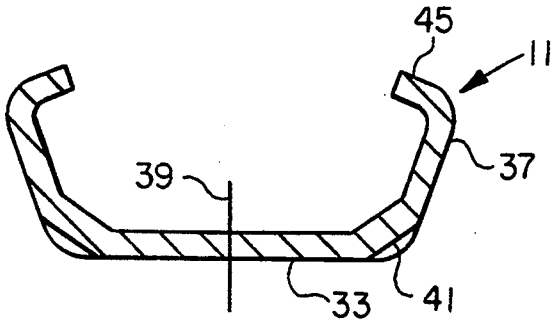
FIG. 7 is a sectional view of the line protector of FIG. 1, taken along the line VII—VII of FIG. 6.

Channel member 11 has an upper portion 23 which terminates in an upper end 25. A central portion 27 locates below upper portion 23. A lower portion 29 locates below central portion 27. Lower portion 29 terminates in a lower end 31. Referring to FIG. 7, channel member 11 includes a base 33 which extends from upper end 25 to lower end 31 (FIG. 5). Base 33 is flat and has a width that is slightly greater than the width of cable 13, as shown in FIGS. 2–4.

As illustrated in FIG. 5, in the upper portion 23 and in the lower portion 29, base 33 is located in the same plane. However, the portion of base 33 in the central portion 27 is located in a different plane. This plane is radially offset relative to the longitudinal axis of tubing 15 (FIG. 1) in an outward direction. The amount of offset is indicated by the numeral 34. Offset 34 is selected so that base 33 in the upper portion 23 and the lower portion 29 will abut tubing 15 above and below the upset areas 21. The central portion 27 of base 33 will not normally touch the upset areas 21. The offset 34 is equal to about one-half the difference in the outer diameter of upset 21 less the outer diameter of the remaining portions of each section of tubing 15.

Figure 8:
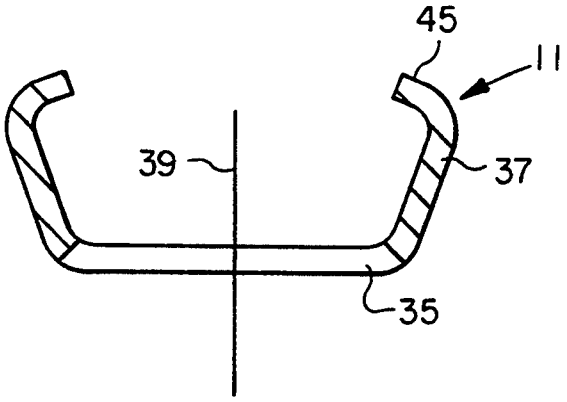
FIG. 8 is a sectional view of the line protector of FIG. 1, taken along the line VIII—VIII of FIG. 6.
Figure 9:
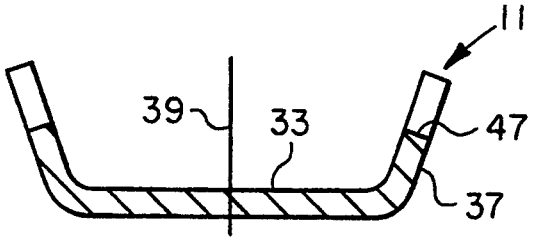
FIG. 9 is a sectional view of the line protector of FIG. 1, taken along the line IX—IX of FIG. 6.

Referring to FIGS. 5 and 8, an elongated rectangular slot or aperture 35 is located in base 33 in central portion 27 of channel member 11. Aperture 35 extends the full width of base 33. Aperture 35 has a length that is selected to be slightly greater than the axial length of coupling 19 (FIG. 1). An outer edge portion of coupling 19 will protrude into aperture 35, as illustrated in FIG. 4.

Referring to FIGS. 7–10, channel member 11 has two outwardly extending sidewalls 37. Sidewalls 37 extend from near the upper end 25 to near the lower end 31. Sidewalls 37 incline relative to each other with the included angle between the sidewalls 37 being about 20 degrees in one embodiment. Radial line 39, illustrated in FIGS. 7–10, is a line that emanates from the longitudinal axis of tubing 15 (FIG. 1). The angle between radial line 39 and each sidewall 37 is about 10 degrees. As shown in FIGS. 2–4, sidewalls 37 protrude outward slightly farther than cable 13. The depth of each sidewall 37 is greater than the thickness of cable 13.

Referring to FIG. 7, a number of gussets 41 are formed in channel member 11 at the intersection of base 33 with sidewalls 37. Each gusset 41 is a small triangular depression. Preferably, two gussets 41 are located in the central portion 27 above aperture 35, and two gussets 41 are located in central portion 27 below aperture 35.

Figure 10:
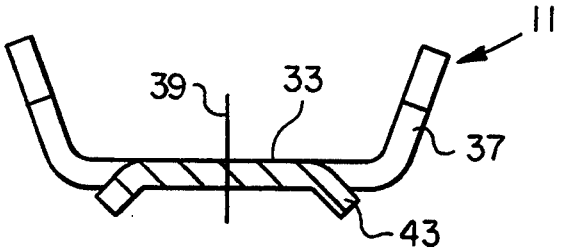
FIG. 10 is a sectional view of the line protector of FIG. 1, taken along the line X—X of FIG. 6.
Figure 11:
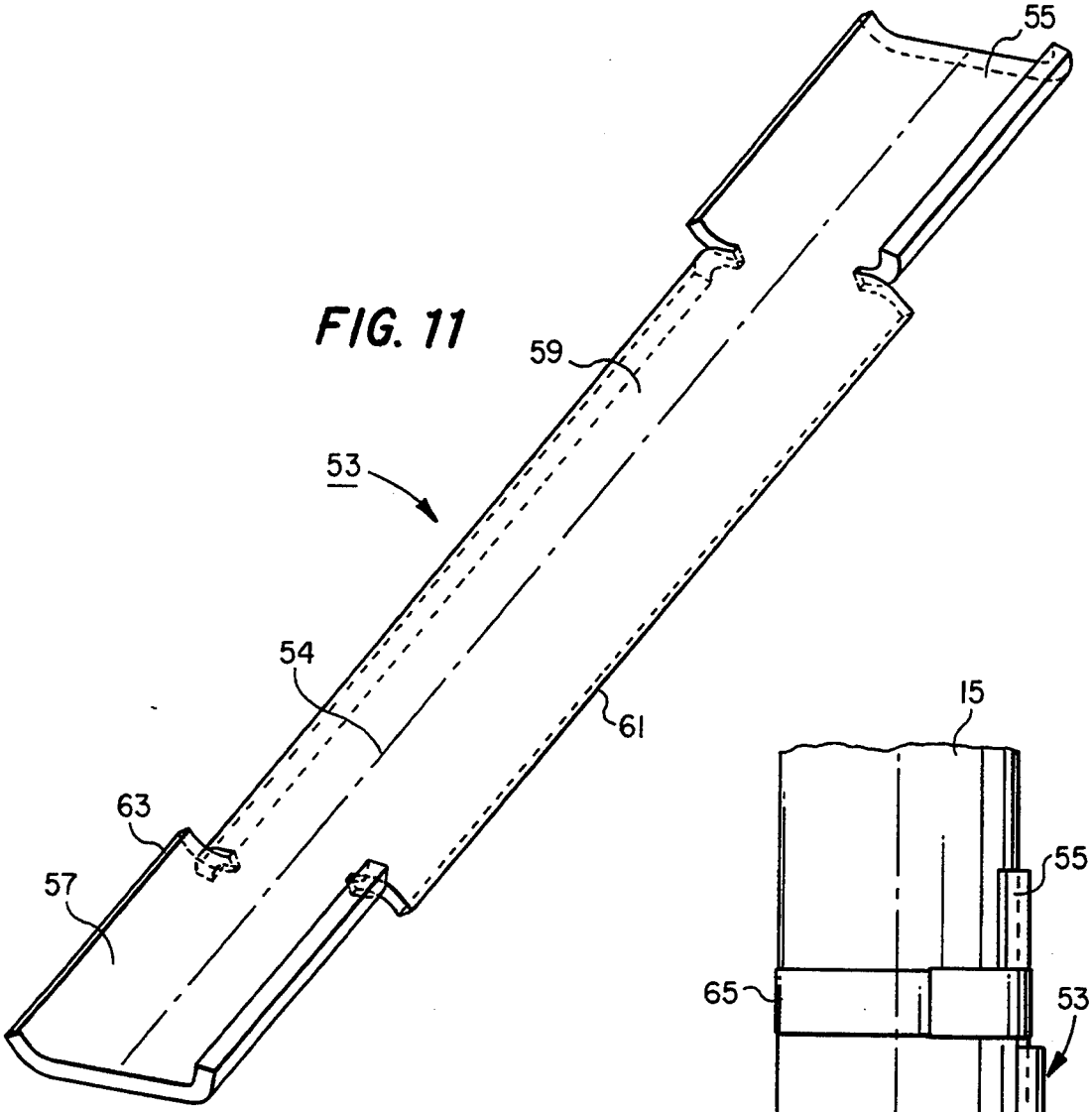
FIG. 11 is a perspective view of an adapter for use in a midsection of a section of tubing between couplings.

As shown in FIG. 10, base 33 has a pair of inward turned tabs 43 at the upper end 25 and also at the lower end 31. Tabs 43 extend inward relative to tubing 15 (FIG. 1) and thus extend in a generally opposite direction from sidewalls 37. Each tab 43 is preferably at an angle of about 30 degrees relative to radial line 39. Tabs 43 thus diverge from base 33, but in an inward direction. Tabs 43 locate alongside and in contact with tubing 15 to maintain axial alignment of channel member 11 with the longitudinal axis of tubing 15 (FIG. 1).

Figure 6:
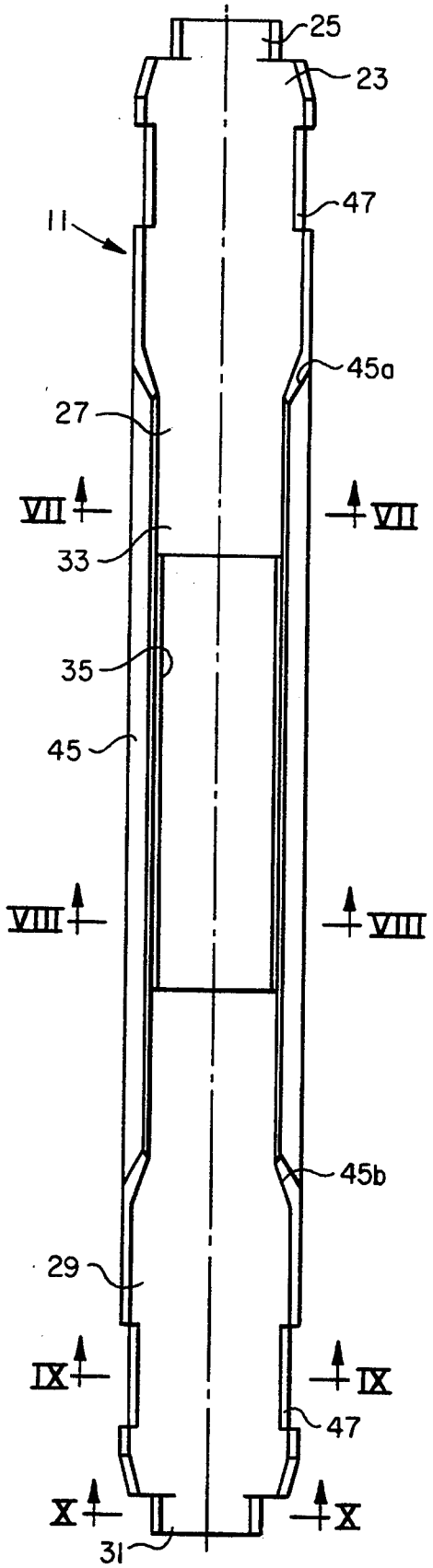
FIG. 6 is a front view of the line protector of FIG. 1, shown prior to mounting to a string of tubing.

A lip 45 extends along each sidewall 37 in central portion 27 (shown in FIG. 7). Each lip 45 is a short section of sidewall 37 bent inward so that they generally oppose each other. The angle between each lip 45 and its sidewall 37 is 90 degrees. As shown in FIG. 6, each lip 45 has an upper end 45*a* that is located at the junction of the central portion 27 with upper portion 23. Each lip 45 has a lower end 45*b* located at the junction of central portion 27 and lower portion 29 of channel member 11. Referring to FIG. 3, the distance between lips 45 is slightly greater than the width of cable 13, allowing cable 13 to pass between lips 45 during installation.

A strap recess 47 (FIGS. 5, 6 and 9), locates in upper portion 23 and lower portion 29. Each strap recess 47 is a rectangular recess formed in the edge of each sidewall 37. Strap recess 47 has a depth that is about one-half the total depth of each sidewall 37. The strap recesses 47 serve to retain metal straps 49 (FIG. 1) which are used to secure channel member 11 to tubing 15. Each strap recess 47 has a length slightly greater than a conventional strap 49 of a type commonly used to strap cable 13 to tubing 15.

In operation, the submersible pump and its motor will be secured to the lower end of a section of tubing 15. The tubing 15 will be lowered into the well, section by section. As it lowers into the well, the cable 13 will be lowered and placed alongside tubing 15. Straps 49 will strap cable 13 to tubing 15 at selected intervals. A channel member 11 will be placed over each coupling 19 to protect cable 13 as it passes alongside coupling 19. Channel member 11 will be positioned with aperture 35 receiving an outer edge portion of coupling 19. Base 33 in upper portion 23 and in lower portion 29 will be in abutment with tubing 15 above and below the upset areas 21.

Cable 13 will be placed in the receptacle defined by base 33 and sidewalls 37. A portion of cable 13 will contact the outer edge portion of coupling 19 where it protrudes through aperture 35. Straps 49 are then placed around the assembly in the strap recesses 47. Each strap 49 tightly secures channel member 11 to tubing 15. FIGS. 2–4 illustrate the assembly in relation to casing 51. As shown in FIG. 4, sidewall lips 45 may contact the inner diameter of casing 51.

Referring to FIGS. 11–15, an adapter 53 is shown for use in securing channel member 11 to the tubing 15 between the couplings 19 (FIG. 1). Adapter 53 is used if additional protection is desired for line or cable 13 in a midsection of tubing 15. A typical section of tubing 15 may be around 30 feet in length, thus the adapter 53 will be about 15 feet away from each coupling 19 (Fig. 1).

Adapter 53 has an upper end section 55 and a lower end section 57. An intermediate section 59 locates between the upper end section 55 and the lower end section 57. Adapter 53 is an elongated brace having a longitudinal axis 54 that will be parallel to the longitudinal axis of tubing 15 once installed.

Intermediate section 59 has two outer edges 61 which turn outward relative to axis 54. Outer edges 61 curve gradually from a flat central portion within intermediate section 59. Outer edges 61 are straight and parallel with longitudinal axis 54. The upper end section 55 and the lower end section 57 each have inner edges 63 which curve and extend inward, opposite from outer edges 61. Inner edges 63 are also straight edges parallel with axis 54. Inner edges 63 extend slightly around tubing 15, while outer edges 61 extend generally radially away from tubing 15.

Figure 12:
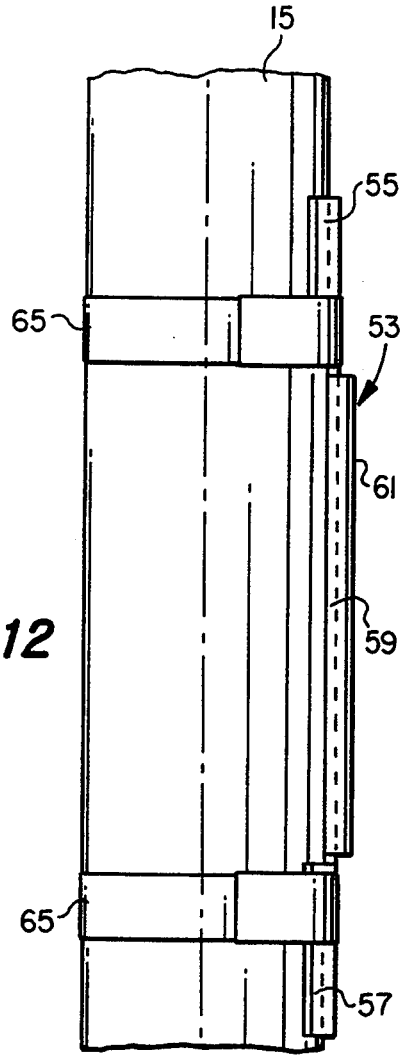
FIG. 12 is a side view of the adapter of FIG. 11, shown installed on a section of tubing.
Figure 13:
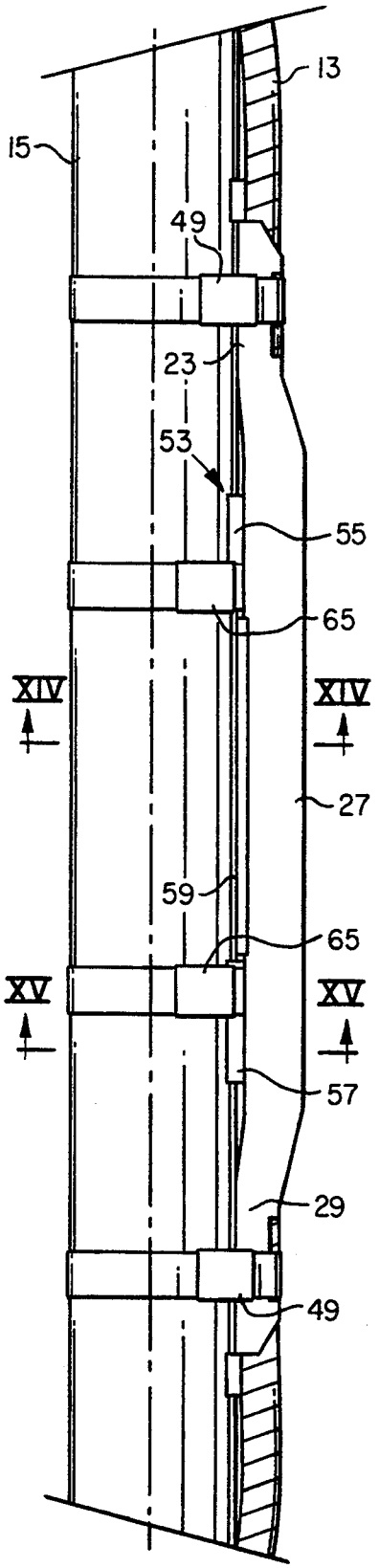
FIG. 13 is a side view of the adapter of FIG. 11, shown installed on a section of tubing, and having a line protector of a type as shown in FIG. 1 installed over the adapter.
Figure 15:
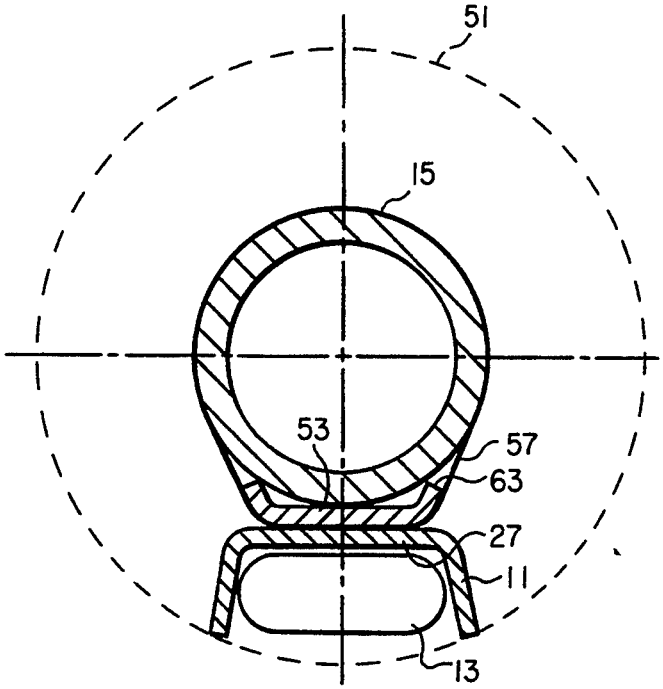
FIG. 15 is a sectional view of the adapter and protector of FIG. 13, taken along the line XV—XV of FIG. 13.

As shown in FIGS. 12, 13 and 15, conventional straps 65 extend around the upper end section 55 and lower end section 57. Straps 65 extend around tubing 15 to tightly secure adapter 53 in place. Adapter 53 will thus result in a projection extending radially outward along one side of tubing 15, as shown in FIG. 12.

Channel member 11 of FIG. 1 fits not only over couplings 19, as shown in FIG. 1, but also will fit over adapter 53, as shown in FIG. 13. The aperture 35 (FIG. 14) receives the outer edges 61 of intermediate section 59. The radial protrusion of adapter 53 is approximately the same as the protrusion of an outer edge portion of a coupling 19 (FIG. 1). Consequently, adapter 53 simulates a coupling 19.

Figure 14:
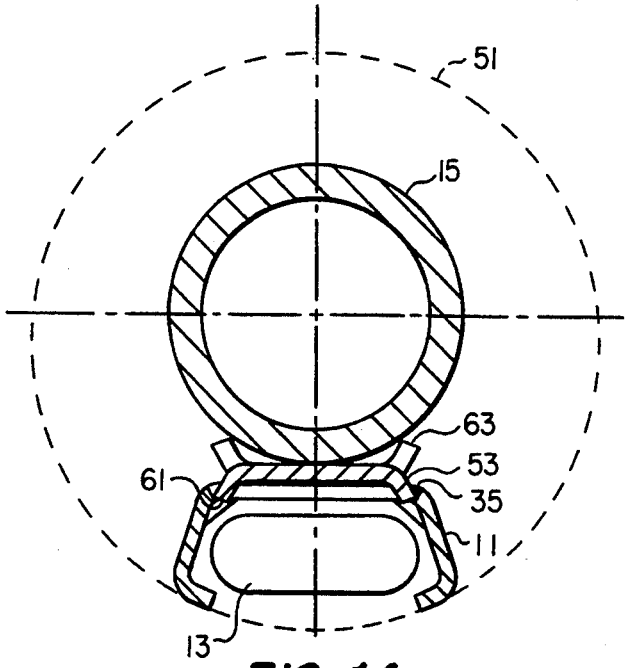
FIG. 14 is a sectional view of the adapter and protector of FIG. 13, taken along the line XIV—XIV of FIG. 13.

The axial lengths of outer edges 61 are substantially the same axial length as aperture 35. The total axial length from the upper end of upper end section 55 to the lower end of lower end section 57, however, is considerably shorter than the axial length of channel member 11. The total axial length of adapter 53 is slightly less than the axial length of the central portion 27 of channel member 11. Consequently, the entire adapter 53 locates within the central portion 27 of channel member 11. The upper portion 23 and lower portion 29 of channel member 11 will still be in contact with tubing 15. Part of the central portion 27 of channel member 11 will contact the outer sides of upper and lower end sections 55, 57. Cable 13 will extend through channel member 11, as shown in FIG. 14, spaced slightly away from the outer side of the intermediate section 59 of adapter 53.

In the operation of the embodiment shown in FIGS. 11–15, first, the operator places the adapter 53 alongside tubing 15 at a point in a midsection approximately equidistant between two of the ends of the section of tubing 15. The user places straps 65 around adapter 53 using a conventional strapping tool. The outer edges 61 will face outward. The inside surfaces of the intermediate section 59 and the upper and lower end sections 55, 57 will be in contact with tubing 15.

Then the user places channel member 11 over adapter 53. The outer edges 61 of intermediate section 59 will insert into the aperture 35. The operator places cable 13 in the receptacle of channel member 11. Then the operator will place straps 49 over the upper and lower portions 23, 29 of channel member 11. The location of the intermediate section outer edges 61 in aperture 35 locks the channel member 11 to the tubing 15, limiting axial movement.

The invention has significant advantages. The channel member, being of single piece construction, is constructed less expensively than certain prior art types. The aperture in the base locates around the coupling, serving to limit axial movement of the channel member relative to the coupling. The protector is easier to install than certain prior art types. The straps provide a convenient means for securing the channel member. The adapter allows the protector to be utilized in a midsection of a section of tubing.

While the invention has been shown in only one of its forms, it should be apparent to those skilled in the art that it is not so limited, but is susceptible to various changes without departing from the scope of the invention.

We claim:

1. An apparatus for protecting a line which is strapped to a string of well tubing, the tubing having a plurality of projections protruding from an outer diameter of the tubing, the apparatus comprising in combination:

a channel member having upper and lower ends, a base and two spaced apart sidewalls having inner edges joined to the base and outer edges extending therefrom, the channel member being open at the outer edges of the sidewalls defining an outward facing open receptacle for receiving the line;

an aperture located in a central portion of the base between the upper and lower ends and configured for receiving an outer edge portion of one of the projections; and securing means for securing the upper and lower ends of the channel member to the tubing with the base in direct contact with the tubing, with the outer edge portion of the projection located in the aperture, and with the line located in the receptacle; and wherein the securing means comprises a pair of straps which extend around the tubing, over the outer edges of the sidewalls, overlying the line, one at each end of the channel member.

2. The apparatus according to claim 1 wherein the base has an upper portion and a lower portion which are offset relative to the central portion in a radial inward direction, so that the upper portion and lower portion will abut portions of the tubing above and below the projection.

3. The apparatus according to claim 1 wherein each of the strap is in direct contact with an outer side of the line.

4. The apparatus according to claim 1 wherein the securing means comprises:

a recess formed in the outer edge of each sidewall adjacent to the upper end and adjacent to the lower end; and wherein the upper and lower straps extend through the recesses

5. The apparatus according to claim 1, further comprising:

a lip located on a central portion of the outer edge of each sidewall, the lips extending over the base toward each other.

6. The apparatus according to claim 1 wherein the sidewalls diverge relative to each other from the base.

7. The apparatus according to claim 1 wherein the central portion of the base is flat.

8. The apparatus according to claim 1 wherein at least some of the projections comprise threaded couplings which secure sections of tubing together.

9. An apparatus for protecting a line which is strapped to a string of well tubing, the tubing having a plurality of projections protruding from an outer diameter of the tubing, the apparatus comprising in combination:

a channel member having upper and lower ends, a base and two spaced apart sidewalls extending therefrom, defining a receptacle for receiving the line;

an aperture located in a central portion of the base between the upper and lower ends and configured for receiving an outer edge portion of one of the projections; and securing means for securing the upper and lower ends of the channel member to the tubing with the base in contact with the tubing, with the outer edge portion of the projection located in the aperture, and with the line located in the receptacle ; and wherein at least some of the projections comprise threaded coupling which secure sections of tubing together; and wherein at least some of the projections comprise adapters mounted to the sections of tubing and axially spaced between two of the couplings.

10. In a well having a string of tubing having a longitudinal axis and made up of sections that secure together, the string of tubing having a plurality of projections protruding outward from an outer diameter of the tubing, a line strapped to the tubing and connected to a submersible pump located on a lower end of the tubing, an apparatus for protecting the line where it passes alongside each of the projections, comprising in combination:

a channel member having upper and lower ends, a base and two spaced apart sidewalls having inner edges joined to the base and outer edges diverging outward from the base relative to the longitudinal axis, defining a radially outward facing open receptacle for receiving the line;

an aperture located in a central portion of the base between the upper and lower ends and configured for receiving an outer edge portion of the projection; and upper and lower straps securing the channel member to the tubing, one of the straps adjacent each end of the channel member, encircling the tubing and extending over the outer edges of the sidewalls and in contact with an outer side of the line with the base in direct contact with the tubing, with the outer edge portion of the projection located in the aperture, and with the line located in the receptacle.

11. The apparatus according to claim 10 wherein the base has an upper portion and a lower portion which are offset relative to the central portion in a radial inward direction relative to the longitudinal axis of the tubing.

12. The apparatus according to claim 10, further comprising:

a recess formed in the outer edge of each sidewall adjacent to the upper end and adjacent to the lower end of the channel member, each recess receiving one of the straps.

13. The apparatus according to claim 10, further comprising:

a lip located on a central portion of the outer edge of each sidewall, the lips extending over the base toward each other.

14. The apparatus according to claim 10 wherein the central portion of the base is flat.

15. The apparatus according to claim 10 wherein the base has an upper portion and a lower portion located adjacent the upper and lower ends, respectively, of the channel members, and wherein the apparatus further comprises:

a pair of upper tabs on the upper portion of the base, extending inward from the upper portion of the base into contact with the tubing; and a pair of lower tabs on the lower portion of the base, extending inward from the lower portion of the base into direct contact with the tubing.

16. In a well having a string of tubing having a longitudinal axis and made up of sections that secure together, the string of tubing having a plurality of projections protruding outward from an outer diameter of the tubing, a line strapped to the tubing and connected to a submersible pump located on a lower end of the tubing, an apparatus for projecting the line where it passes alongside each of the projections, comprising in combination:

a channel member having upper and lower ends, a base and two spaced apart sidewalls diverging outward from the base relative to the longitudinal axis, defining a receptacle for receiving the line;

an aperture located in a central portion of the base between the upper and lower ends and configured for receiving an outer edge portion of the projection; and upper and lower straps securing the channel member to the tubing, one adjacent each end of the channel member, encircling the tubing with the base in contact with the tubing, with the outer edge portion of the projection located in the aperture, and with the line located in the receptacle; and wherein at least some of the projections comprise threaded couplings which secure sections of tubing together; and wherein at least some of the projections comprise adapters mounted to the sections of tubing and axially spaced between two of the couplings.

17. In a well having a string of tubing having a longitudinal axis and made up of sections that secure together by threaded couplings, each section of tubing having an upset area adjacent the coupling, the well having a power line strapped to the tubing for supplying power to a submersible pump located on a lower end of the tubing, an apparatus for protecting the line where it passes alongside each of the couplings, comprising in combination:

a channel member having upper and lower ends, a flat base and two spaced apart sidewalls diverging outward from the base relative to the longitudinal axis, defining a receptacle which receives the line;

the base having an upper portion, a central portion, and a lower portion, the upper and lower portions being offset relative to the central portion in a radial inward direction relative to the longitudinal axis of the tubing, with the upper and lower portions of the base in contact with section of the tubing above and below the upset areas, respectively;

an aperture located in the central portion of the base, the aperture having a longitudinal length slightly greater than the longitudinal length of the coupling and receiving an outer edge portion of the coupling;

a recess formed in each sidewall adjacent to the upper end and adjacent to the lower end;

a lip located on a central portion of each sidewall, the lips extending over the base toward each other;

upper and lower straps securing the channel member to the tubing, one extending in one of the recesses adjacent each end of the channel member, encircling the tubing and retaining the line in the receptacle;

a pair of upper tabs on the upper portion of the base, extending inward from the upper portion of the base into contact with the tubing; and a pair of lower tabs on the lower portion of the base, extending inward from the lower portion of the base into contact with the tubing.

18. The apparatus according to claim 17, further comprising at least one adapter strapped to one of the sections of tubing and axially spaced between two of the couplings, the adapter projecting outward from the tubing, one of the channel members locating over the adapter and receiving a portion of the adapter within the aperture of the channel member.

19. An apparatus for protecting a line which is strapped to a string of well tubing having a longitudinal axis, the tubing having a plurality of sections secured together by threaded couplings, the apparatus comprising in combination:

at least one adapter, the adapter being elongated and having upper and lower end sections separated by an intermediate section, the intermediate section having an outer edge portion;

strap means for strapping the adapter to one side of one section of the tubing in a midsection of the section of tubing axially between the couplings and with the outer edge portion of the intermediate section protruding outward relative to the longitudinal axis;

at least one midsection channel member, each midsection channel member having upper and lower ends, an axial length greater than an axial length of the adapter, a base and two spaced apart sidewalls extending therefrom, defining a receptacle for receiving the line;

an aperture located in a central portion of the base of the midsection channel member between the upper and lower ends and configured for receiving the outer edge portion of the adapter; and securing means for securing the upper and lower ends of the midsection channel member to the tubing over the adapter with the base in contact with the tubing, with the outer edge portion of the adapter located in the aperture, and with the line located in the receptacle.

20. The apparatus according to claim 19 further comprising:

at least one coupling channel member, each coupling channel member having upper and lower ends, a base and two spaced apart sidewalls extending therefrom, defining a receptacle for receiving the line;

an aperture located in a central portion of the base of the coupling channel member between the upper and lower ends and configured for receiving the outer edge portion of one of the couplings; and securing means for securing the upper and lower ends of the coupling channel member to the tubing over one of the couplings with the base in contact with the tubing, with the outer edge portion of the coupling located in the aperture of the coupling channel member, and with the line located in the receptacle and having a portion in contact with the outer edge portion of the coupling.

21. The apparatus according to claim 19 wherein the strap means comprises a pair of straps, each of which extend over one of the end sections of the adapter.

22. The apparatus according to claim 19 wherein the outer edge portion of the adapter comprises a pair of longitudinal outer edges extending outward from the intermediate section.

23. The apparatus according to claim 19 wherein:

the outer edge portion of the adapter comprises a pair of longitudinal outer edges extending outward from the intermediate section; and wherein the upper and lower end sections each have a pair of longitudinal inner edges extending inward from the upper and lower ends.

* * * * *